US006200166B1

(12) United States Patent
King

(10) Patent No.: US 6,200,166 B1
(45) Date of Patent: Mar. 13, 2001

(54) SMART CARD INTERFACE ARRANGEMENTS

(75) Inventor: John King, Sawbridgeworth (GB)

(73) Assignee: Taika Denki Co., Ltd., Tokyo (JP)

( * ) Notice: Subject to any disclaimer, the term of this patent is extended or adjusted under 35 U.S.C. 154(b) by 0 days.

(21) Appl. No.: 09/359,323

(22) Filed: Jul. 23, 1999

(30) Foreign Application Priority Data

Sep. 24, 1998 (GB) ..... 9820710

(51) Int. Cl.[7] ..... H01R 24/00
(52) U.S. Cl. ..... 439/630; 439/17; 235/485
(58) Field of Search ..... 439/630, 17; 235/485, 235/484, 482, 475

(56) References Cited

U.S. PATENT DOCUMENTS

| | | | | |
|---|---|---|---|---|
| 3,227,860 | * | 1/1966 | Blodgett | 235/485 |
| 4,004,136 | * | 1/1977 | Torok et al. | 235/485 |
| 4,575,703 | | 3/1986 | Shishido . | |
| 4,612,436 | | 9/1986 | Okada . | |
| 5,146,069 | * | 9/1992 | Orimoto et al. | 235/485 |
| 5,161,992 | | 11/1992 | Birch . | |
| 5,252,815 | | 10/1993 | Pernet . | |
| 5,317,138 | | 5/1994 | Togawa . | |
| 5,470,260 | * | 11/1995 | Schwan et al. | 439/630 |
| 5,864,114 | | 1/1999 | Fukuda . | |

* cited by examiner

*Primary Examiner*—Neil Abrams
*Assistant Examiner*—Javaid Nasri
(74) *Attorney, Agent, or Firm*—Oliff & Berridge, PLC

(57) ABSTRACT

A smart card interface that allows data to be transferred between a smart card and an external data device. The smart card interface receives a smart card having at least one card electrical contact, and comprises at least one roller that rotates when the smart card interface receives the smart card.

8 Claims, 5 Drawing Sheets

SMART CARD INTERFACE ARRANGEMENTS

FIELD OF THE INVENTION

The invention relates to smart card interface arrangements and particularly, although not exclusively, to smart card interface arrangements adapted to connect smart cards complying with International Standard ISO 7816 to external data devices, such as computers.

DESCRIPTION OF THE RELATED ART

Smart cards are an extension of conventional plastic cards having a magnetic strips on which information is stored. Such conventional plastic cards are commonly used for bank and credit cards. Smart cards usually contain a microprocessor chip which is capable of storing information and which communicates with the outside world by means of a number of electrical contacts provided on the card. International Standard ISO 7816 sets out a number of specifications relating to the design and layout of smart cards.

Smart card interface arrangements allow the smart card to interface with an external data device, such as a computer. However, known smart card interface arrangements all cause wear and degradation of the smart card when used repeatedly over a period of time. This is because of friction between the card and electrical contacts within the interface arrangement, or between the card and biasing elements within the interface arrangement, when the card is inserted into, and removed from, the interface arrangement.

For example, the electrical contact may be a raised metallic projection, which tends to scratch the card and the card's electrical contacts as the card is inserted. Similarly, the biasing element may be a simple resilient projection made of plastics material, adapted to press the card towards the electrical contacts of the interface arrangement, which can also cause wear to the card. In addition, such a biasing element suffers from the disadvantage that it does not apply pressure uniformly across the card, and over time the card may become warped as a result.

SUMMARY OF THE INVENTION

The invention seeks to overcome at least some of the disadvantages of the prior art.

According to the invention there is provided a smart card interface arrangement for allowing data to be transferred between a smart card and an external data device, said arrangement being adapted to receive a smart card having at least one card electrical contact, and comprising at least one roller arranged to rotate when said arrangement receives said smart card.

An advantage of such a roller is that it reduces friction on the smart card when the smart card is moved in and out of the interface arrangement.

In one embodiment of the invention said roller is an electrical contact roller and is provided with at least one roller electrical contact adapted to rotate with said electrical contact roller and make electrical contact with said card electrical contact on said smart card.

In an alternative embodiment of the invention said roller is a biasing roller adapted to apply a force to the opposite side of said smart card to said card electrical contact.

In a further embodiment of the invention, the smart card interface arrangement is provided with both said electrical contact roller and said biasing roller.

At least part of the biasing roller may be formed from a pliable and/or resilient material adapted to deform to some degree when said smart card is received by the interface arrangement.

The biasing roller may be spring-loaded, and may be rotatably mounted about a movable axis which is biased towards said smart card when said smart card is received by the interface arrangement.

The electrical contact roller may be provided with a number of roller electrical contacts, such as four.

In one embodiment of the smart card interface arrangement, the electrical contact roller is provided with eight roller electrical contacts.

The electrical contact roller may be provided with a friction member adapted make contact with said smart card and cause said electrical contact roller to rotate when said smart card is moved.

Preferably, the or each roller electrical contact is provided with a fixed electrical contact which is adapted for connection (directly or indirectly) to said external data device, and with which said roller electrical contact continues to make electrical contact even when said electrical contact roller rotates.

BRIEF DESCRIPTION OF THE DRAWINGS

The invention will now be more particularly described, by way of example only, with reference to the accompanying drawings, in which.

DETAILED DESCRIPTION OF EXEMPLARY EMBODIMENTS

Figure 1:
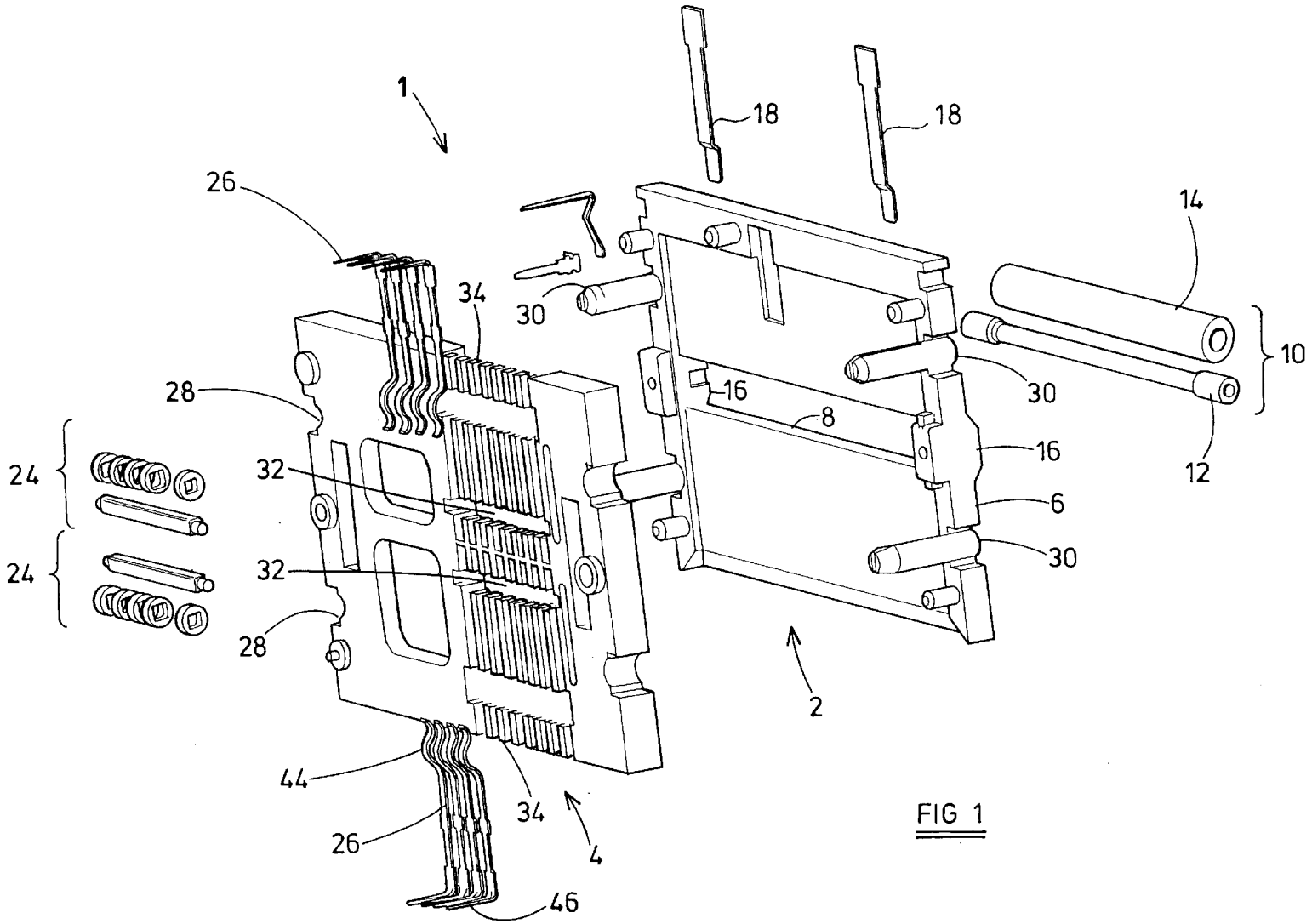
FIG. 1 is an exploded view of a smart card interface arrangement comprising upper and lower parts.
Figure 3:
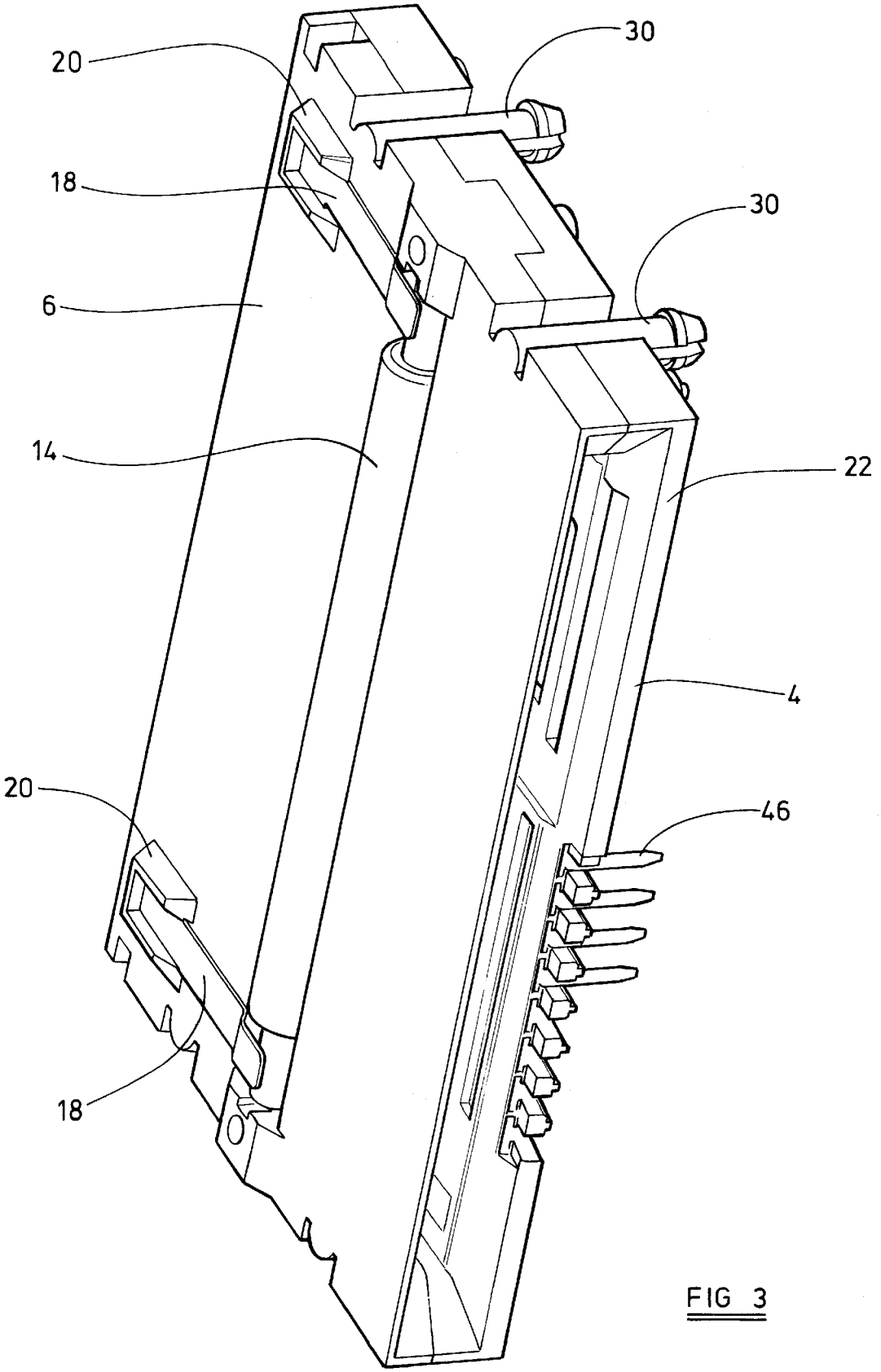
FIG. 3 is a perspective view of the interface arrangement from above, showing the upper and lower parts connected together.

Referring to FIG. 1, the interface arrangement 1 comprises an upper part 2 and a lower part 4. The upper part 2 comprises an upper support structure 6 moulded from plastics material, and defining an opening 8 adapted to support a biasing roller 10, comprising a central spindle 12 and an outer friction sleeve 14. The central spindle 12 can be formed from any suitable rigid material, for example metal or plastics material, and the outer friction sleeve 14 can be formed from any resilient or flexible material which will grip a smart card (not shown), for example fluorosilicone, or nitrile rubber. The friction sleeve 14 fits over the central spindle 12, which is mounted within the opening 8 by means of two spindle supports which are integrally moulded as part of the upper support structure 6. The biasing roller 10 is held in position by two metal spring fingers 18, as can be seen more clearly in FIG. 3. The spring fingers 18 are supported within support housings 20, which are integrally moulded as part of the upper support structure 6. The ends of the central spindle 12 are free to move vertically within the spindle supports 16, and the spring fingers 18 ensure that the biasing roller 10 is biased towards the smart card, which is inserted between the upper part 2 and lower part 4 during operation.

The lower part 4 comprises a lower support structure 22, two electrical contact rollers 24, and eight fixed electrical contacts 26.

The lower support structure 22 is integrally moulded from plastics material, and comprises four recesses 28 adapted to engage with four projections 30 provided on the upper support structure 6, when the upper and lower parts 2 and 4 are brought together. The lower support structure 22 is also provided with two apertures 32 adapted to receive the two electrical contact rollers 24, and two sets of eight grooves 34, each adapted to receive up to eight fixed electrical contacts 26.

Figure 2:
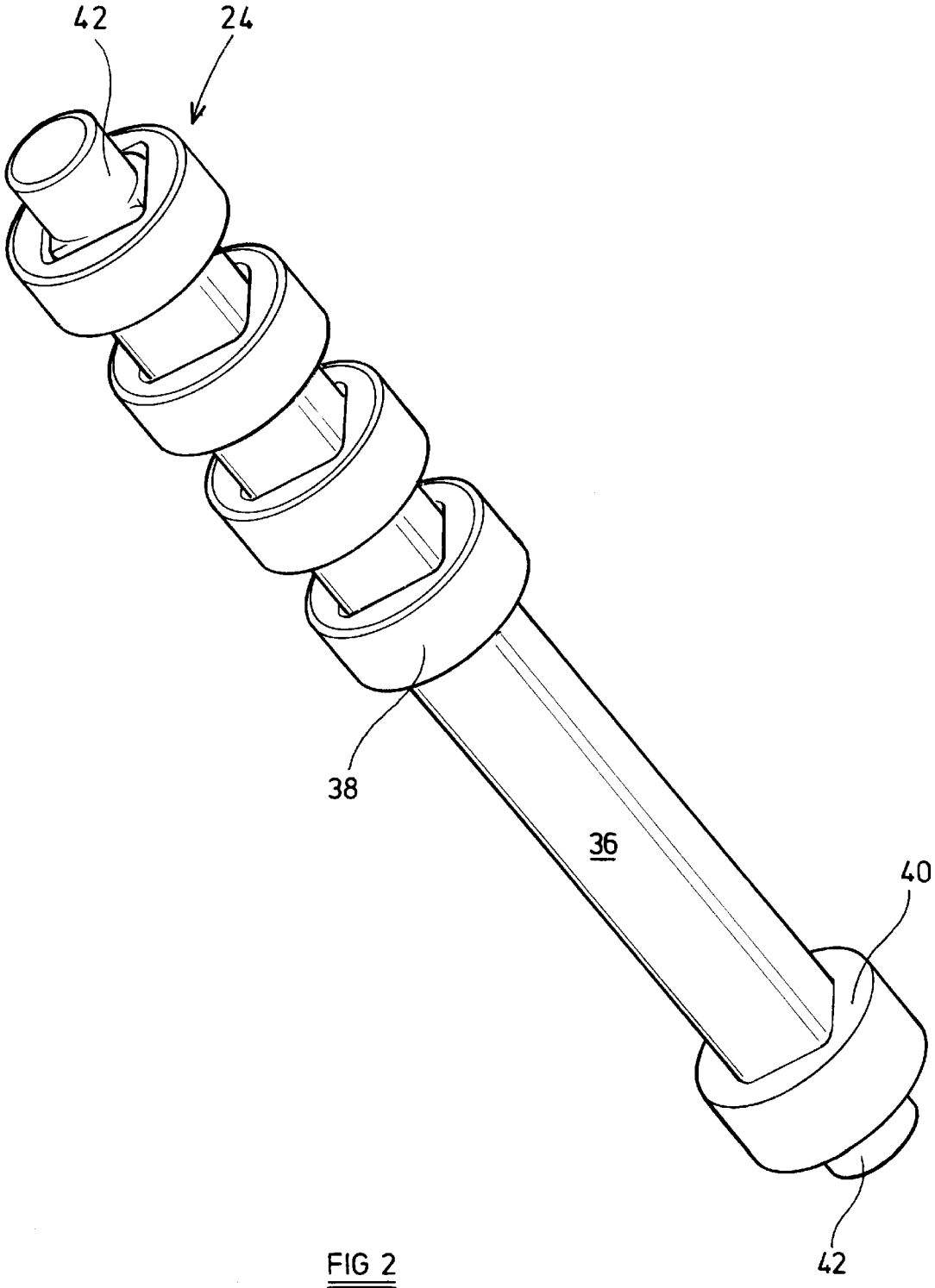
FIG. 2 is a perspective view of an electrical contact roller of the interface arrangement.

The structure of each electrical contact roller 24 is shown in greater detail in FIG. 2. Each electrical contact roller 24 comprises a central spindle 36, on which are mounted four roller electrical contacts 38, and a friction member 40. The roller electrical contacts 38 are formed from metal, and the friction member 40 is formed from fluorosilicone, or nitrile rubber. The two ends 42 of the central spindle 36 are of circular cross-section, and adapted to be housed in, and rotate within, suitable mountings on the lower support structure 22. The remainder of the central spindle 36 is of generally square cross-section, and each roller electrical contact 38 and friction member 40 is provided with a generally square central aperture of complementary cross-section to the central spindle 36. This ensures that when a smart card is inserted into the interface arrangement, the friction member 40 grips the surface of the smart card and rotation of the friction member 40 drives rotation of the central spindle 36, and hence rotation of the roller electrical contacts 38.

Figure 4:
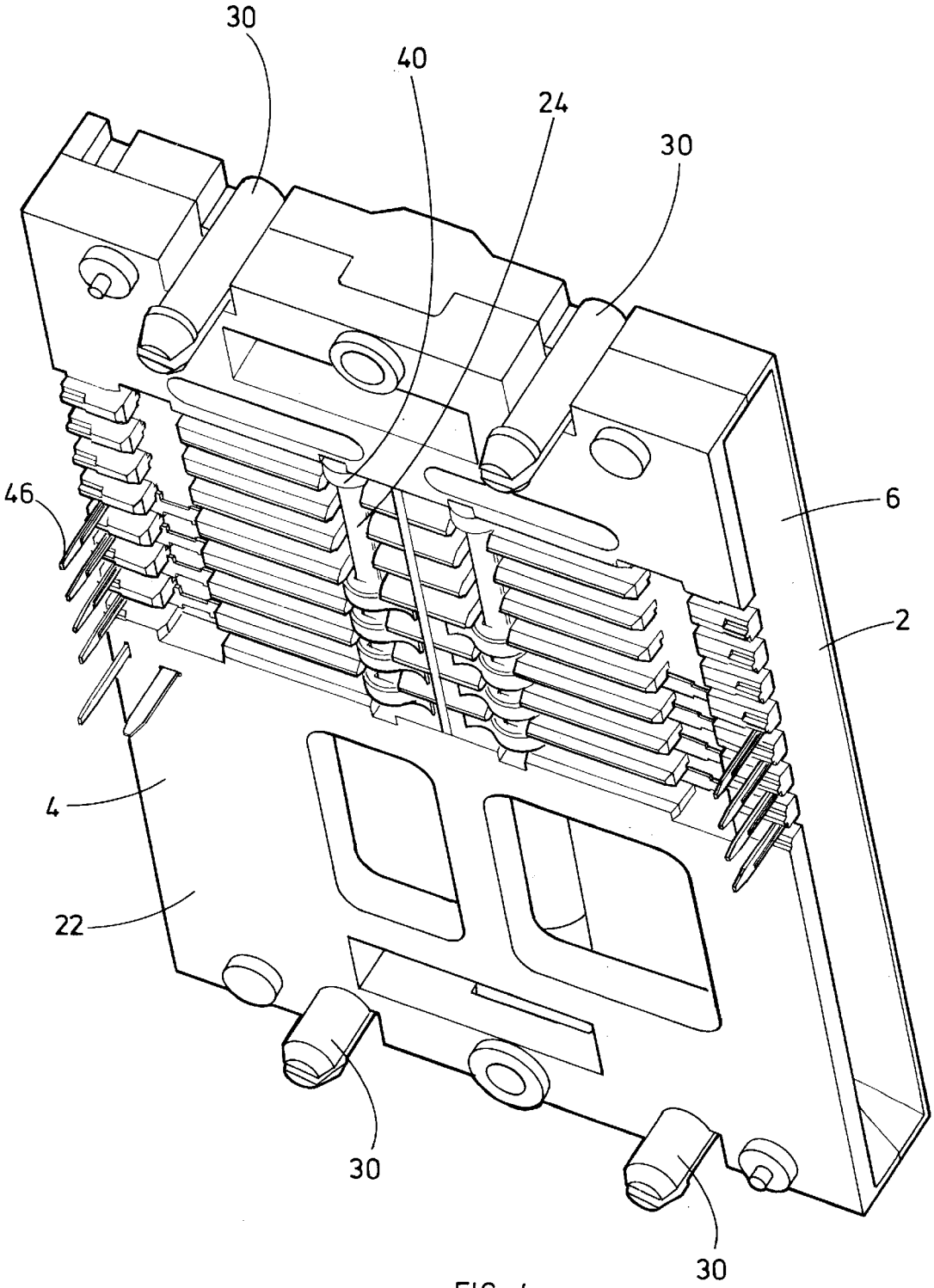
FIG. 4 is a perspective view of the interface arrangement from below, showing the upper and lower parts connected together.
Figure 5:
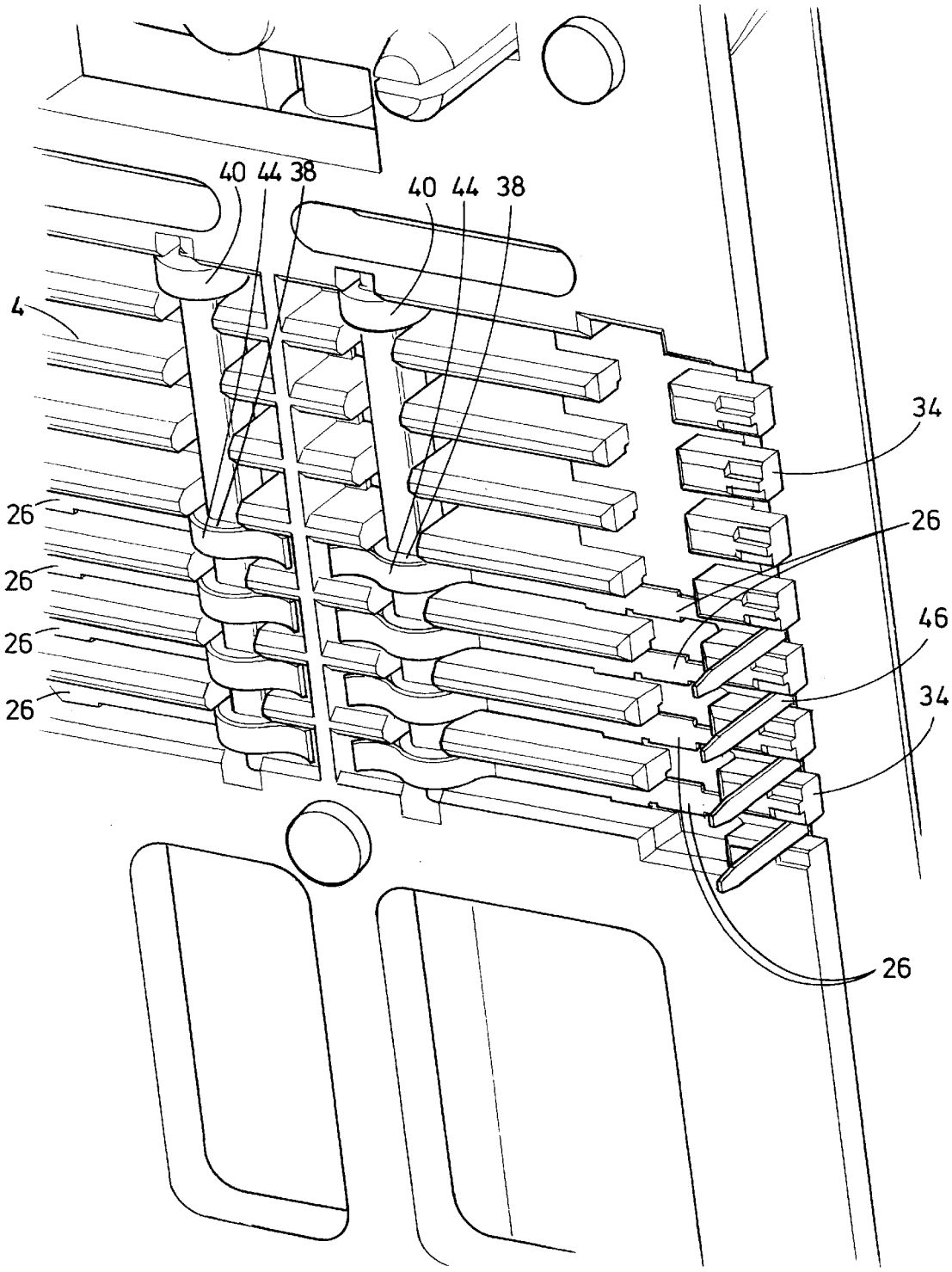
FIG. 5 is an enlarged view showing part of the lower part of the interface arrangement in greater detail.

The fixed electrical contacts 26 can be seen more clearly in FIGS. 4 and 5. Each fixed electrical contact 26 is formed from a single piece of metal, and comprises an indented portion 44 adapted to make contact with a roller electrical contact 38, and a right-angled connection portion 46 adapted to be plugged into a suitable external data device adapted to exchange information with a smart card inserted into the interface arrangement. Each indented portion 44 is adapted to maintain electrical contact with a roller electrical contact 38 even when the roller electrical contact 38 rotates.

During operation of the smart card interface arrangement described above, a smart card is inserted between the upper and lower parts 2 and 4. Rotation of the biasing roller 10 and the electrical contact rollers 24 ensure that wear of the smart card is minimised. Furthermore, the biasing roller 10 acts to press the smart card against the electrical contact rollers 24, so that electrical contacts on the smart card achieve a good electrical contact with the roller electrical contacts 38.

What is claimed is:

1. A smart card interface that allows data to be transferred between a smart card and an external data device, wherein the interface is adapted to receive a smart card having at least one card electrical contact formed on a first surface of the smart card, the smart card interface comprising:

at least one electrical contact roller arranged to rotate when the interface receives the smart card, wherein the electrical contact roller is provided with at least one roller electrical contact adapted to rotate with the electrical contact roller and make electrical contact with the at least one card electrical contact; and a biasing roller adapted to apply a force to a second side of the smart card opposite the first side of the smart card.

2. The smart card interface as claimed in claim 1, wherein at least a part of the biasing roller is formed from a pliable, resilient, or pliable and resilient material adapted to deform when the smart card is received by the interface.

3. The smart card interface as claimed in claim 1, wherein the biasing roller is biased by at least one spring member, the biasing roller is mounted about a movable axis and the biasing roller is biased against the smart card when the smart card is received by the interface.

4. The smart card interface as claimed in claim 1, wherein the electrical contact roller is provided with four electrical contacts.

5. The smart card interface as claimed in claim 1, wherein the electrical contact roller is provided with eight electrical contacts.

6. The smart card interface as claimed in claim 1, wherein the electrical contact roller is provided with a friction member adapted to make contact with the smart card and to cause the electrical contact roller to rotate when the smart card is moved.

7. The smart card interface as claimed in claim 1, wherein each at least one roller electrical contact is provided with a fixed electrical contact which is adapted for electrical connection to the external data device, and each at least one roller electrical contact continues to make an electrical contact when the electrical contact roller rotates.

8. The smart card interface as claimed in claim 1, wherein the electrical contact roller is provided with a plurality of roller electrical contacts.

* * * * *